US007174610B2

(12) United States Patent
Rissin et al.

(10) Patent No.: US 7,174,610 B2
(45) Date of Patent: Feb. 13, 2007

(54) FLEXIBLE MATERIAL CLUTCH FOR A DECORATIVE PIECE

(75) Inventors: Joseph Rissin, Baldwin, NY (US); Eil Galicki, Ft. Lee, NJ (US)

(73) Assignee: Galicki & Rissin, LLC, Baldwin, NY (US)

( * ) Notice: Subject to any disclaimer, the term of this patent is extended or adjusted under 35 U.S.C. 154(b) by 25 days.

(21) Appl. No.: 10/822,085

(22) Filed: Apr. 9, 2004

(65) Prior Publication Data

US 2005/0223741 A1 Oct. 13, 2005

(51) Int. Cl.
*A44C 7/00* (2006.01)

(52) U.S. Cl. ..... 24/705

(58) Field of Classification Search ..... 29/896.4, 29/896.42; 63/13, 1.18, 12, 3, 3.1, 40; 24/705
See application file for complete search history.

(56) References Cited

U.S. PATENT DOCUMENTS 3,698,044 A 10/1972 Chernow
4,630,453 A * 12/1986 Burkett ..... 63/12
4,843,699 A * 7/1989 Seidman ..... 29/896.42

* cited by examiner

*Primary Examiner*—Jack W. Lavinder
(74) *Attorney, Agent, or Firm*—Stephen E. Feldman

(57) ABSTRACT

An improved securing clutch comprises a flexible material retainer with an engagement passage sized to receive and frictionally engage the entire outer surface of a portion of a post. The flexible material retainer is surrounded by a metal frame that provides a base plate at the front of the retainer and handles at the back.

17 Claims, 2 Drawing Sheets

FLEXIBLE MATERIAL CLUTCH FOR A DECORATIVE PIECE

FIELD OF THE INVENTION

The present invention deals with securing clutches for decorative pieces such as earrings and broaches, and more specifically, a flexible material securing clutch.

BACKGROUND OF THE INVENTION

Earrings are pieces of jewelry usually worn on the lower ear lobe, although it has become increasingly popular to wear them anywhere on the ear. The earring typically has a decorative face attached to a post which is mounted onto an ear lobe by placing the post through a piercing and affixing an ear-clutch onto the free end to prevent the post from slipping through. The ear lobe is then sandwiched between the decorative face and the ear-clutch.

According to the prior art, the ear-clutch can be screwed onto a threaded post or slid onto a post with an outer surface that may be smooth, notched or fluted. Usually, such a slide-on ear-clutch has a base plate with a center opening and a pair of bent-out fingers rolled into a circular shape and positioned so that a portion of that circular shape will frictionally engage the outer surface of a jewelry post when the post is pushed through the center opening in the base plate. When removing the jewelry or ornament, the ear-clutch must first be slid off the post with sufficient force to overcome the engagement friction. Doing so requires a spreading of the fingers to disengage the post. Constant spreading of the fingers over time causes the fingers to lose their elasticity, severely weakening the post-finger engagement, and therefore, the earring mount. Eventually, the post attached to the decorative face is prone to falling out unintentionally, which is why so many earrings and ear clutches are lost.

Broaches, lapel pins, hat pins, tie tacks and other forms of decorative pieces function in much the same way. Metal fingers engage a friction area on a post to secure a decorative face on a piece of fabric. The post pierces a piece of fabric, the lapel of a jacket, a hat, or a blouse, for example, and engages a clutch on the other side.

Such an arrangement is difficult to remove, especially if the wearer is not particularly adept at handling such small mechanical pieces. A man with large hands would have a difficult time removing a tie tack with such a post and finger arrangement, for example. Earrings are especially difficult by their very nature because the clutch is usually very small and behind the ear lobe, making it virtually impossible to see. Some attempts have been made to provide a securing clutch that is easier to use and more durable with better gripping strength.

U.S. Pat. No. 3,698,044 to Chernow purports to disclose a clutch mechanism for jewelry pins with a gripper portion with a flexible insert to handle the clutch. The flexible insert is encased in metal, making it difficult and expensive to manufacture.

SUMMARY OF THE INVENTION

An improved securing clutch for a decorative piece is provided wherein a flexible material retainer frictionally engages the entirety of a portion of an exterior surface of a post. The clutch is attached to the post by axially sliding the clutch onto the post and removed by axially sliding it off.

The securing clutch comprises a retainer of a flexible material having a front end, a back end, and an engagement passage running through its interior from the front end to the back end. A metal frame surrounds the retainer to secure the retainer within the frame and provide a base plate at the front end and handles at the back end.

A decorative face is attached to one end of a post having a slightly larger width than that of the engagement passage. The difference in widths is designed so that the engagement passage is constructed and arranged to retain the post by frictionally engaging the entire exterior surface of a portion of the post.

A method for making the improved flexible material clutch is provided as well, the method comprising the steps of providing a flexible material retainer with a front end and a back end, providing a metal frame with an aperture substantially at its center, the metal frame being shaped substantially similar to a clutch with wings, inserting the front end into the aperture, bending the wings around the retainer in a first direction, and then bending the tips of the wings opposite the first direction to provide handles at the wing tips. Preferably, the wings are hollowed-out.

An alternative method for making the securing clutch comprises the steps of providing an open frame with a base plate at a frame front end and handles at a frame back end, the base plate having an opening of a first width. A retainer of flexible material having a retainer front end and a retainer back end with an internal engagement passage of a second width being greater than the first width running from the retainer front end to the retainer back end is then inserted into the metal frame with the retainer front end at the frame front end, the retainer back end at the frame back end, and the engagement passage aligned with the opening.

DETAILED DESCRIPTION

Figure 1:
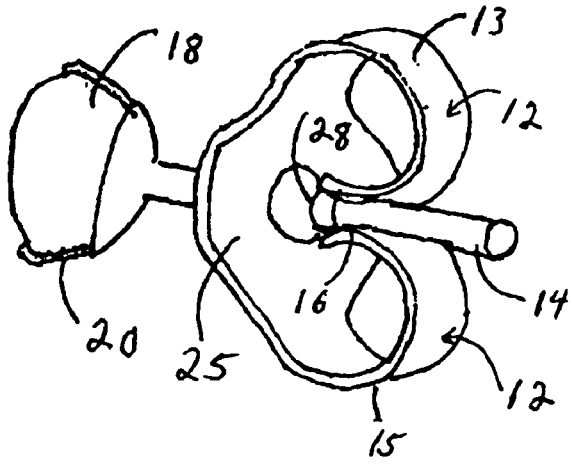
FIG. 1 PRIOR ART
FIG. 1 shows a prior art earring arrangement.

FIG. 1 shows a prior art earring arrangement. A decorative jewel 18, which may be a precious or semi-precious stone including a diamond, ruby, sapphire, or pearl, is set onto a post 14 with prongs 20 holding the jewel 18 in place. A base plate 25 has curled fingers 12 that exert pressure inwardly, toward each other, on opposite sides of the post 14 at an engagement surface 16 which include a notch on the post 14 and a matching slot on the fingers 12.

To remove the base plate 25 from the post 14, the fingers 12 are pinched between a user's fingers to pull the base plate 25 away from the user's ear (not shown). Oftentimes however, a user will grip the outer surfaces 13 and 15, pushing the fingers 12 in, thereby increasing the engagement friction. It would be both advantageous and desirable to eliminate the mechanical functioning of the metal fingers. However, a secure engagement means is needed to maintain the decorative piece in its mount.

The repeated application of force to the fingers 12 spreading them apart eventually causes plastic (permanent) deformation, severely weakening the friction at the engagement surface 16. In addition, the side to side movement of the post elongates the hole in the base plate 25. As a result, the post 14 is prone to becoming loose and falling out from the base plate 25 and therefore, out of the ear lobe into which the earring is affixed.

The same arrangement can be found on broaches, lapel pins, ear wires, posts and other decorative pieces, namely, a post and clutch where the fingers engage a small portion of the post at a friction engagement surface. Metal fingers are manipulated to disengage the clutch from the post. These metal fingers, whether on an earring or broach, are susceptible to deformation from repeated application of force, and once a permanent deformation occurs, so does a substantial decrease in engagement friction. In addition, it should be noted that prior art clutches are usually designed to accommodate a specific thickness and may work with different size posts but will distort them over time.

When metals, or any material for that matter, are subject to forces, or stress, they deform (elongate, compress, twist) or break as a function of the applied force, length of time it is applied, the temperature at which it is applied, and other conditions of application. When the stress is removed, the material returns to the dimensions (shape) it had before the load was applied if its yield point (point at which permanent deformation sets in) was not exceeded. Even when the yield point is not surpassed, however, deformation becomes permanent, over time, even after the stress is removed.

If a material is taken beyond the yield point and the stress is then released, the material ends up with a permanent deformation, or set. If the stress is reapplied, the material again responds elastically at the beginning up to a new yield point that is higher than the original yield point. In other words, the material will continue to further deform from its original shape.

The "softness" quality of metals stems from their atomic structure and metallic bond of the metal atoms that form a crystalline structure. Electrons in metallic bonds are free to move about their positive ions in an electron cloud or gas, which acts to glue, or bond the ions together. This free movement, within limits, also allows for the movement of the atoms under the influence of an external load. This slight movement, visible only under the most powerful microscopes, is called elastic deformation or elastic strain. Once the external force, such as a bending force, is removed, the internal electrical forces that cause the atoms to move will decrease, allowing the atoms to return to their normal position, leaving no sign of ever being moved. If a piece of spring steel such as a money clip is deformed, it will return to its original shape, thus experiencing elastic deformation.

If too much external force is applied by excessively bending the clip, the atoms might move too far from their original positions to be able to move back again when external force is released. Consequently, the money clip would be permanently bent and no longer fit for use. This permanent deformation is known as plastic flow, plastic slip, plastic deformation, or permanent set.

When two metal surfaces are brought together, as in a friction engagement surface, the area of asperity-to-asperity contact is extremely small so the pressure is very high. Even at small contact loads plastic deformation occurs at the asperities, while the underlying metal still deforms elastically. As the normal load is increased the asperities deform and fracture, thus increasing the real area of contact.

Figure 2:
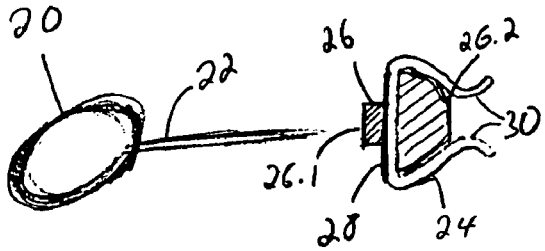
FIG. 2 shows an exemplary securing clutch in accordance with an embodiment of the present invention.
Figure 2A:
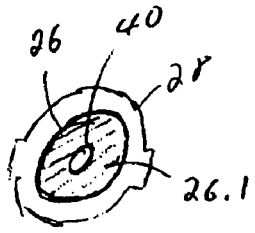
FIG. 2*a* shows a front view of the clutch of FIG. 2.

FIG. 2 shows an improved securing clutch in accordance with an embodiment of the present invention. FIG. 2*a* shows a front view of the clutch depicting an engagement passage 40 in a flexible material retainer 26 surrounded by a base plate 28. The flexible material is preferably a rubber or latex, such as polyurethane.

Figure 3:
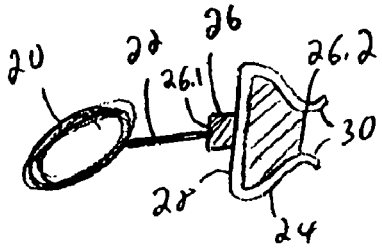
FIG. 3 shows the clutch of FIG. 2 securing an earring post.

Referring back to FIG. 2 in conjunction with FIG. 2*a*, a decorative piece 20 is attached to a post 22. A flexible material retainer 26 is set in a frame 24 (preferably metal), which provides handles 30 and a base plate 28. The engagement passage 40, which provides a passage from the front end 26.1 of the retainer 26 to the back end 26.2, receives the post 22 at the front end 26.1, as depicted in FIG. 3. The width of the passage 40 is slightly smaller than that of the post 22 to provide frictional contact over the entire outer surface of the post 22 portion inserted into the retainer 26 by the inner walls of the passage 40. Thus, a more secure engagement and attachment mechanism is achieved while simultaneously providing a clutch that is easier to remove since the retainer 26 only needs to be slid back and forth along the longitudinal axis of the post 22. The frictional engagement between the flexible material and the metal post is strong enough to hold the post in place, yet soft enough to allow easy removal of the clutch.

In addition, because the retainer 26 is flexible, it can accept posts of different sizes and thickness. Preferably, the width of the passage 40 is small enough to engage the thinnest post commercially available. In this way, the passage is small enough to frictionally engage thin posts and because of its flexibility, will stretch to accommodate thicker posts. Furthermore, the shape of the passage 40 does not have to match the shape of the post. Put another way, a square post can fit into a round passage because the flexible material of the retainer 26 will stretch to accommodate posts of different sizes and shapes.

The base plate 28 preferably has an opening large enough to receive and wrap around the protrusion at the retainer's front end 26.1 Preferably, the base plate 28 is substantially flat or smooth when it will be positioned against an ear lobe or fabric in use. Alternatively, the retainer 26 may be shaped so that there is no protrusion at the front end 26.1 so that the front end 26.1 is flush with the surface of the base plate 28. Assembled, the post 22 and engagement passage 40 are aligned along a common axis so that the post 22 is retained in a fixed position within the retainer 26 and the base plate should not contact the post 22.

In use, the decorative face 20 is readily secured to, and separated from, the clutch by grasping the clutch by its handles 30 between two fingers on one hand and the face 20 in the other hand. The post 22 is inserted through the opening in an ear lobe (not shown) or piece of fabric so that the face is on the outer surface of the ear lobe. Since the engagement passage 40 is slightly smaller than the post, a friction engagement results over the entire portion of the post inserted into the retainer 26 which firmly, yet slidably, secures the post 22 and the decorative face 20 together when the post 22 is inserted into the engagement passage 40. Since flexible material is used, the retainer 26 experiences much less wear than normal. The retainer 26 is slid onto the post 22 until the base plate 28 is set against the inner surface of the ear lobe or fabric on which the piece is to be worn. The space or gap between the base plate 28 and the decorative face 20 can readily be adjusted by merely sliding the retainer 26 along the longitudinal axis of the post 22.

It should be noted that it may be preferable, in some circumstances, to have one end of the passage in the retainer closed so that the post cannot pass completely through the retainer and the post terminates in the retainer. The closed end reduces the chance that the end of the post will stick or jab the wearer behind the ear or clothing. Having an open end, however, is advantageous because it permits the piece to be worn on materials of varying thickness. For example, with an earring, if the ear lobe is thin, the clutch can be positioned closer to the ear lobe. For the lapel of a thick heavy coat, the clutch and piece would be set farther apart to accommodate the thicker layer of fabric.

Alternatively, the engagement passage may be open at one end and tapered shut at the other end. In this way, the tapered, closed end acts as a safety to catch a notch included on many posts, thus preventing slippage and accidental removal of the post from the clutch.

In accordance with further aspects of this feature, both ends can be closed by a very thin layer to provide a sterile clutch to a user. In this way, the interior of the passage is sealed and sterile before use so a user can be confident that the clutch has not been used before, greatly reducing the risk of infection.

Figure 4A:
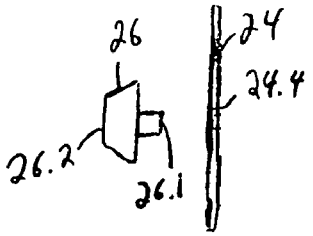
FIG. 4*a* shows a securing clutch being made in accordance with an embodiment of the present invention.

An exemplary process for making an improved clutch in accordance with an embodiment of the present invention is shown in FIGS. 4*a* to 4*d*. FIG. 4*a* shows the flexible material retainer 26 and the metal frame 24. The retainer 26 is preferably shaped like a rivet with an over-sized head at its back end 26.2 and a cylindrical protrusion at its front end 26.1. The metal frame 24 is flat at this point, with an engagement passage 40 in its center sized to receive a portion of the retainer 26.

Figure 4B:
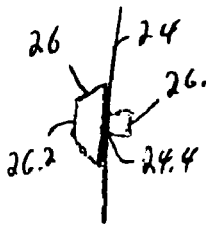
FIG. 4*b* shows a further step in the making of the clutch in FIG. 4*a*.
Figure 4C:
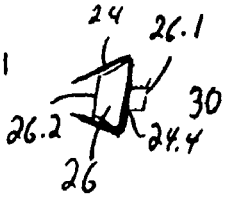
FIG. 4*c* shows the next further step in the process of making the clutch of FIG. 4*b*.
Figure 4D:
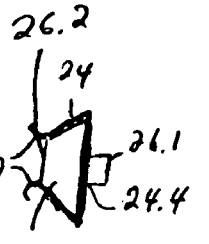
FIG. 4*d* shows the final step in the process of making the clutch of FIG. 4*c*.

The cylindrical protrusion of the front end 26.1 of the retainer 26 is inserted into the frame 24 through a hole 24.4 as depicted in FIG. 4*b*. The frame 24 is then bent around the head of the retainer 26 as shown in FIG. 4*c*, surrounding the retainer 26 to securely hold it therein without encasing the retainer 26 in its entirety. FIG. 4*d* shows the last step where the ends of the frame 24 are bent out to provide handles 30, making it easier to grab the clutch for removal from its post.

In accordance with a preferred embodiment of the present invention, the overall dimensions of the clutch approximate a cube, in other words, the length, width and height of the piece are substantially similar. The length of the clutch, overall, from tip of the front end 26.1 to the tip of the handles 30 is 90–110% of the width of the base plate from one outer edge to the opposite outer edge. The height of the clutch is 90–100% of the base plate width.

Figure 5:
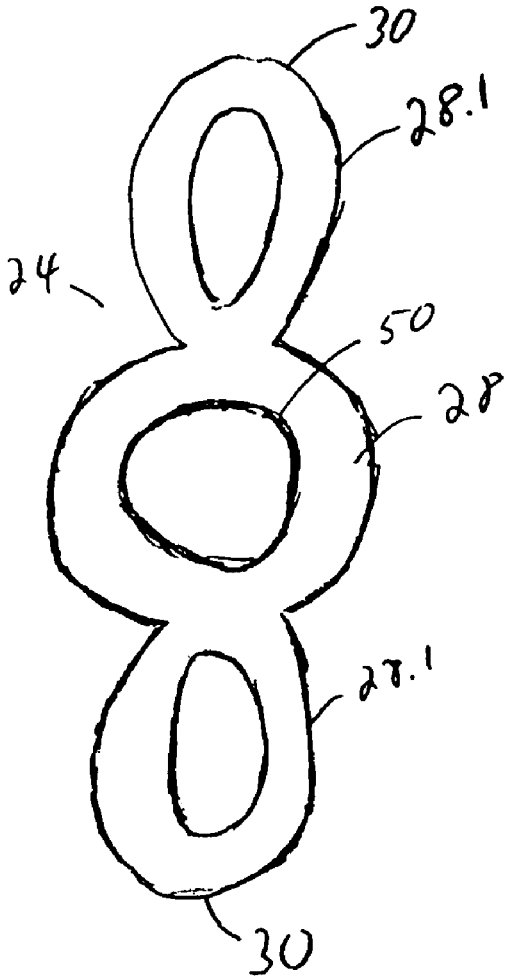
FIG. 5 shows a metal frame in accordance with an embodiment of the present invention.

FIG. 5 shows a front view of an exemplary frame 24 before being formed to encase the flexible material retainer. The frame 24 includes the base plate 28 with hollowed-out wings 28.1 to provide an open configuration, that is, will not completely encase the retainer. The wings 28.1 may be solid metal, however a hollowed or pierced-out configuration makes the clutch lighter and the wings 28.1 easier to manipulate during the forming process of bending the frame 28 around the retainer 26. The middle section provides the base plate 28 and the outer edges of the wings 28.1 provide the handles 30 once the frame 24 is bent around the retainer (see FIG. 4*d*). The hole 50 in the middle is sized to receive the cylindrical protrusion 26.1 on the front end of the flexible material retainer 26.

In accordance with a preferred embodiment of the present invention, the wings 28.1 are 1 to 1.5 times the width of the base plate. The diameter of the hole 50 is 25–75% of the diameter of the base plate 28 from one outer edge to another.

Figure 6:
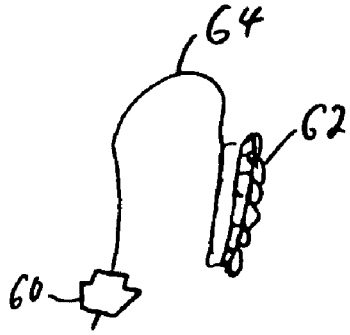
FIG. 6 shows a clutch in accordance with an embodiment of the present invention on an ear wire.

The shape of the post is inconsequential to practicing the invention disclosed herein. Put another way, the example above uses a straight post, however, the inventive clutch will securely engage a post of any shape. For example, FIG. 6 shows the inventive clutch 60 securely engaging the end of a wire post 64 with a decorative face 62.

Figure 7:
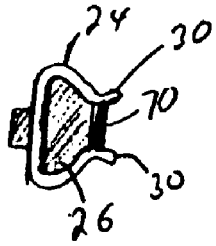
FIG. 7 shows an alternative embodiment including a support ring between the handles.

In accordance with further aspects of the present invention, FIG. 7 shows the flexible material retainer 26 and metal frame 24 with a support ring 70 for supporting the handles 30 against inward pressure to maintain the shape of the frame 24 and handles 30.

In accordance with an alternative embodiment of a method for making the clutch, the open frame can be formed first and the flexible material retainer inserted therein. Because the material is flexible and can reform without permanent set, it can be manipulated to fit within the frame after the frame is formed.

In this way, much less metal is needed to make a securing clutch according to an embodiment of the present invention, providing a less expensive piece since substantially less metal is used in the manufacturing process. It is acceptable for the flexible material in the clutch to show because the securing clutch typically is not outwardly visible. It is usually hidden behind and ear lobe or piece of fabric such as a tie, jacket lapel or hat.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A securing clutch for a decorative piece comprising:

a flexible material retainer having a front end, a back end, and an engagement passage running through the interior of the retainer substantially at its center from the front end to the back end, the engagement passage being a first width;

a metal frame surrounding the retainer to secure the retainer within the frame, the metal frame providing a base plate at the front end and handles at the back end, the base plate being substantially planar, and whereby the front end of retainer has a protrusion extending beyond the base plate.

2. The securing clutch of claim 1 further comprising:

a decorative face;

a post with a decorative end having the decorative face attached thereto and a free end, the post being a second width; wherein the second width is slightly larger than the first width, and the engagement passage is constructed and arranged to retain the post by frictionally engaging the entire exterior surface of a portion of the post.

3. The securing clutch of claim 1 wherein the back end is closed.

4. The securing clutch of claim 1 wherein the back end is open.

5. The securing clutch of claim 1 wherein the flexible material retainer is shaped like a rivet.

6. The securing clutch of claim 1 wherein the protrusion is cylindrical.

7. The securing clutch of claim 1 wherein the flexible material is polyurethane.

8. The securing clutch of claim 1 wherein the flexible material is rubber.

9. The securing clutch of claim 1 wherein the flexible material is polyurethane.

10. The securing clutch of claim 1 wherein the flexible material is rubber.

11. The securing clutch of claim 1 wherein the flexible material is polyurethane.

12. The securing clutch of claim 1 wherein the flexible material is rubber.

13. A method for making a securing clutch comprising the steps of:

providing an open frame with a base plate at a frame front end and handles at a frame back end, the base plate having an opening of a first width;

providing a retainer of flexible material having a retainer front end and a retainer back end with an internal engagement passage, of a second width less than the first width, the engagement passage running from the retainer front end to the retainer back end;

providing a support ring between the handles; and inserting the retainer into the metal frame with the retainer front end at the frame front end, the retainer back end at the frame back end, and the engagement passage axially aligned with the opening.

14. A method for making a securing clutch for a decorative piece, the method comprising the steps of:

providing a flexible material retainer with a front end and a back end;

providing a metal frame with an aperture substantially at its center, the metal frame being shaped substantially similar to a clutch with wings;

inserting the front end into the aperture;

bending the wings around the retainer in a first direction;

bending the tips of the wings opposite the first direction to provide handles at the wing tips.

15. The method of claim 14 wherein the front end further comprises a cylindrical protrusion.

16. The method of claim 14 wherein the back end further comprises an over-sized rivet head.

17. The method of claim 14 wherein the wings are hollowed-out.

* * * * *